US005505270A

United States Patent [19]

Wentworth

[11] Patent Number: 5,505,270

[45] Date of Patent: Apr. 9, 1996

[54] REVERSIBLE PNEUMATIC GROUND PIERCING TOOL

[75] Inventor: Steven W. Wentworth, Brookfield, Wis.

[73] Assignee: Earth Tool L.L.C., Oconomowoc, Wis.

[21] Appl. No.: 325,689

[22] Filed: Oct. 19, 1994

[51] Int. Cl.[6] ..... E21B 1/04; E21B 4/14

[52] U.S. Cl. ..... 173/1; 173/91

[58] Field of Search ..... 173/1, 17, 91, 173/135, 137

[56] References Cited

U.S. PATENT DOCUMENTS

| | | | |
|---|---|---|---|
| 3,616,865 | 11/1971 | Sudnishnikov et al. . | |
| 3,756,328 | 9/1973 | Sudnishnikov et al. . | |
| 4,250,972 | 2/1981 | Schmidt . | |
| 4,683,960 | 8/1987 | Kostylev et al. . | |
| 5,025,868 | 6/1991 | Wentworth et al. . | |
| 5,050,686 | 9/1991 | Jenne | 173/91 |
| 5,109,932 | 5/1992 | Bueter et al. | 173/91 |
| 5,172,771 | 12/1992 | Wilson | 173/91 |
| 5,199,151 | 4/1993 | Wentworth et al. . | |
| 5,226,487 | 7/1993 | Spektor . | |
| 5,311,950 | 5/1994 | Spektor . | |
| 5,337,837 | 8/1994 | Wentworth et al. | 173/91 |

*Primary Examiner*—Scott A. Smith
*Attorney, Agent, or Firm*—Foley & Lardner

[57] ABSTRACT

A pneumatic ground piercing tool has a reversing mechanism than can be operated by remote control but which does not contain a moving valve member inside the tool which become jammed. Such a tool generally includes, as essential components, an elongated tubular housing having a rear opening, a striker disposed for reciprocation within an internal chamber of the housing to impart impacts to a rear impact surface of the anvil for driving the body through the ground, an air distributing mechanism for effecting reciprocation of the striker, a tail assembly mounted in a rear end opening of the housing that secures the striker and air distributing mechanism in the housing, and a reversing mechanism including a supplemental air line capable of supplying compressed air for reverse operation to a radial port in the air distributing mechanism. Opening the supplemental air line to the atmosphere produces a short stroke forward mode of operation useful for operations wherein a less forceful impact is desirable.

12 Claims, 4 Drawing Sheets

REVERSIBLE PNEUMATIC GROUND PIERCING TOOL

TECHNICAL FIELD

This invention relates to pneumatic impact tools, particularly to reversible self-propelled ground piercing tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearwardly, the radial holes pass back over the step and isolate the front chamber of the tool from the compressed air supply. The momentum of the striker carries it rearwardly until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body.

See, for example, Sudnishnikov et al. U.S. Pat. No. 3,756,328 and Wentworth et al. U.S. Pat. Nos. 5,025,868 and 5,199,151. The threaded connection allows the operator to rotate the air supply hose and thereby displace the stepped air inlet rearwardly relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole. Sudnishnikov U.S. Pat. No. 3,616,865 describes a screw-reverse tool wherein exhaust is ported through a central tube that extends in parallel with the compressed air inlet.

Screw reverse mechanisms have obvious limitations. Rotating the hose can become difficult if the tool has traveled far underground, and in any case the tool cannot be switched to reverse rapidly. For this reason, several reversing mechanisms have been proposed which use a second source of compressed air in order to actuate a valve in the tool in order to switch to reverse. See Schmidt U.S. Pat. No. 4,250,972, Spektor U.S. Pat. No. 5,226,487 and Wilson U.S. Pat. No. 5,172,771. A tool described in Kostylev U.S. Pat. No. 4,683,960 provides a central port in the middle of the step to exhaust air sooner than normal when the valve is open and divert compressed air through the central port when the valve is closed, but the valve is operated manually by pulling on a cable. A spring biases the valve to the closed position.

A further reversing mechanism described in Spektor U.S. Pat. No. 5,311,950 reverses upon lowering of the pressure of compressed air. The described tool, however, requires many different parts designed to be assembled in a complex manner.

Despite the availability of many alterative reversing mechanisms, a need remains for a system that is simple, easy to use, reliable, and operable by remote control rather than rotating a hose or pulling on a cable. The present invention addresses this need.

SUMMARY OF THE INVENTION

The present invention provides a pneumatic ground piercing tool having a reversing mechanism than can be operated by remote control but which does not contain a moving valve member inside the tool which become jammed and does not require changing the operating pressure of an air compressor. Such a tool generally includes, as essential components, an elongated tubular housing having a rear opening, a striker disposed for reciprocation within an internal chamber of the housing to impart impacts to a rear impact surface of the anvil for driving the body through the ground, an air distributing mechanism for effecting reciprocation of the striker, a tail assembly mounted in a rear end opening of the housing that secures the striker and air distributing mechanism in the housing, and a reversing mechanism including a supplemental air line capable of supplying compressed air for reverse operation. The supplemental air line is connected to a radial port in the air distributing mechanism. Opening the supplemental air line to the atmosphere produces a short stroke forward mode of operation useful for operations wherein a less forceful impact is desirable.

According to a preferred form of the invention, a reversible pneumatic ground piercing tool of the invention comprises an elongated tool body having a rear opening and a front nose including an anvil. A striker is disposed for reciprocation within an internal chamber of the housing to impart impacts to a rear impact surface of the anvil for driving the tool through the ground, the striker having a rear bearing in sealed, sliding engagement with an inner wall of the tool body.

An air distributing mechanism reciprocates of the striker. The air distributing mechanism includes a rearwardly-opening recess in the striker having one or more radial air flow ports extending through a wall of the recess, and a bushing slidably disposed in the recess in sealed engagement with the recess wall, the bushing having a front external edge and a rear external edge. A first air flow passage extends through the bushing from rear to front in a lengthwise direction, and a first air hose is connected to the first air flow passage for supplying compressed air to the recess to push the striker forward until the radial port in the recess wall passes the front edge of the bushing, at which time compressed air enters a forward pressure chamber ahead of the rear seal bearing of the striker, thereby beginning a rearward stroke of the striker. Travel of the striker continues rearwardly until the radial port in the recess wall passes over the rear edge of the bushing, thereby depressurizing the forward pressure chamber in a known manner.

A tail assembly mounted in a rear end opening of the housing secures the striker and air distributing mechanism in the housing, and receives rearward impacts from the striker when the tool is operating in reverse.

The reversing mechanism includes a second air flow passage extending from the rear of the bushing to a radial port on an exterior surface of the bushing between its front and rear external edges, and a second air hose connected to the second air flow passage for supplying compressed air to the radial port in the bushing. This pressurizes the forward pressure chamber when the radial port in the recess wall moves over the radial port in the bushing, and thereby begins a rearward stroke sooner than if no compressed air had been supplied to the radial port of the bushing.

The invention further contemplates a method of operating an impact boring tool of the invention in forward and reverse modes by selectively opening and closing valves connected to each of the air lines. The valves can be located at the air compressor for ease of operation. Other objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
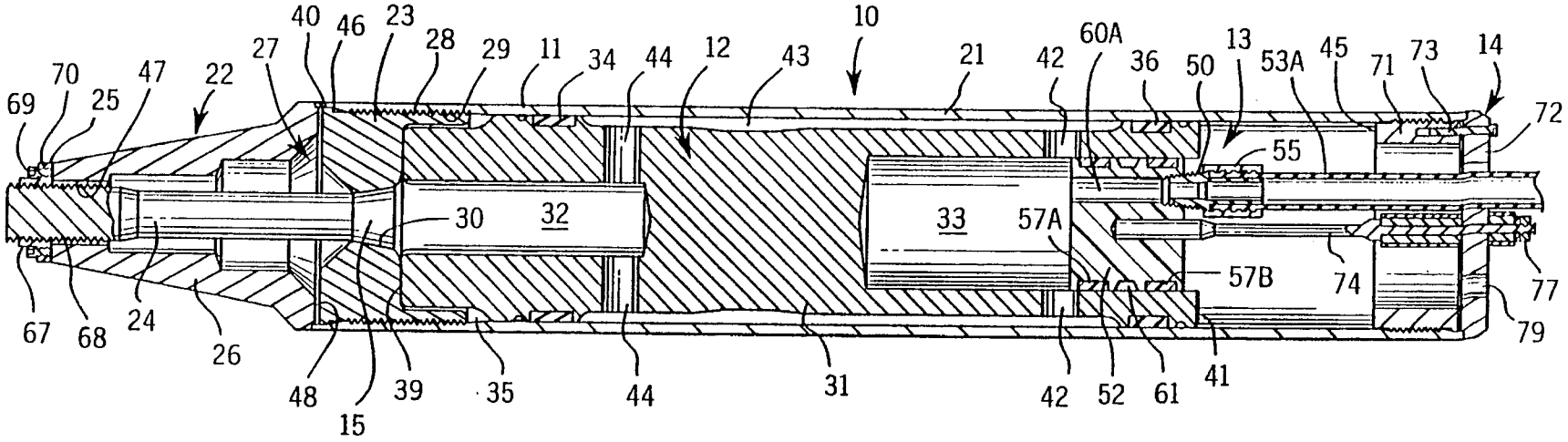
FIG. 1 is a lengthwise sectional view of an impact tool according to the invention taken along the line 1—1 in FIG. 6.

Referring now to FIGS. 1 to 6, a pneumatic ground piercing tool 10 according to the invention includes, as main components, a tool body 11 which includes a tubular housing 21 and head assembly 22 forming a frontwardly tapering nose, a striker 12 for impacting against the interior of body 11 to drive the tool forward, a stepped air inlet conduit 13 which cooperates with striker 12 for forming an air distributing mechanism for supplying compressed air to reciprocate striker 12, a tail assembly 14 which allows exhaust air to escape from the tool, secures conduit 13 to body 11, and a reversing mechanism 16 built into stepped conduit 13.

Tool body 11 and striker 12 are designed in generally in the same manner as described in Wentworth et al. U.S. patent application Ser. No. 07/878,741, filed May 5, 1992, the entire contents of which are incorporated by reference herein. Striker 12 is disposed for sliding, back-and-forth movement inside of tool body 11 forwardly of conduit 13 and tail assembly 14. Striker 12 comprises a generally cylindrical rod 31 having frontwardly and rearwardly opening blind holes (recesses) 32, 33 respectively therein. Pairs of plastic, front and rear seal bearing rings 34, 36 are disposed in corresponding annular grooves in the outer periphery of rod 31 for supporting striker 12 for movement along the inner surface of housing 21. Annular front impact surface 39 impacts against anvil 23 when the tool is in forward mode, and an annular rear impact surface 41 impacts against front end 45 of tail assembly 14 when the tool is in rearward mode.

A plurality of rear radial ports 42 allow communication between recess 33 and an annular space 43 between striker 12 and housing 21 bounded by seal rings 34, 36. A second set of front radial holes 44 allow communication between space 43 and front recess 32. Annular space 43, holes 44, front recess 32 and the interior space of body 11 ahead of rings 34 together comprise the variable-volume forward pressure chamber 35 of the tool.

Tool body 11 comprises a cylindrical tubular housing 21 having a tapered head assembly 22 which may include a detachable head. Head assembly 22 includes an anvil 23 mechanically secured in a front opening 27 of the body, by, for example, external threads 28 engaged with internal threads 29 formed on the inner periphery of housing 21 near the front opening. Anvil 23 has a forwardly extending central rod 24 which extends in the axial direction of the tool. Anvil 23 preferably comprises a steel cylinder having a central hole 30. Rod 24 has a rear end portion 15 which is retained in central hole 30 of anvil 23. Central hole 30 tapers frontwardly, and rear end portion 15 of rod 24 has a frontwardly tapering outer surface that fits closely within central hole 30. Anvil 23 further has a front, outwardly extending annular flange 40 which engages a step 46 formed on the inner periphery of front end opening 27 of housing 21.

Flange 40 engages step 46 and thereby acts as a stop to retain the anvil against excessive rearward movement.

A detachable head 26 is mounted on rod 24 by means of a central opening 47 through which rod 24 extends. Central opening 47 is slightly larger in diameter than rod 24 at a front end of central opening 47 to facilitate sliding movement of the detachable head along rod 24. An inner boss 48 at the rear end of head 26 spaced slightly inwardly from the outer periphery of head 26 fits inside front end opening 27 of housing 21 to help secure head 26 against housing 21 in the proper position.

A releasable locking mechanism 25 secures head 26 over the front opening 27 of housing 21. Releasable locking mechanism 25 includes a ring nut 67 threadedly secured on a front circumferential threaded outer surface portion 68 of rod 24 disposed in front of head 26, whereby head 26 is clamped between housing 21 and nut 67. Mechanism 25 further comprises suitable means for clamp-loading head 26 to the nut 67, such as one or more threaded bolts 69 inserted through threaded holes 70 in nut 67. Holes 70 extend in parallel to the lengthwise axis of the tool and are preferably arranged in a symmetrical formation around the center hole 47 of nut 67.

The ends of bolts 69 engage an annular front surface of detachable head 26, pressing head 26 against housing 21 and thereby stretching rod 24 to provide the clamp-loading effect. The intermediate portion of rod 24 within opening 47 has a slightly reduced diameter to accommodate distortion of rod 24 during stretching. Nose bolts 69 are preferably tightened to exert at least about 100,000 pounds of tensile force on rod 24.

Referring to FIGS. 2 to 6, stepped air inlet conduit 13 includes a tubular bushing 52 and a pair of flexible hoses 53A, 53B. Hoses 53A, 53B, which may be made of rubberized fabric, are secured by couplings 55 to rear end portions of associated fittings 50. Each fitting 50 is threadedly secured in the rear end opening of a lengthwise hole 60A, 60B in the body of bushing 52, thereby forming a pair of air flow passages which supply compressed air to the recess 33 to carry out the forward stroke of the tool in a manner similar to known tools.

The cylindrical outer surface of bushing 52 is inserted into recess 33 in slidable, sealing engagement with the wall thereof. Cavity 33 and the adjoining interior space of stepped conduit 13 together comprise a rear pressure chamber which communicates intermittently with the front, variable pressure chamber by means of holes 42. Bushing 52 may, if needed, have front and rear plastic bearing rings 57A, 57B disposed in annular peripheral grooves to reduce air leakage between bushing 52 and the wall of cavity 33. Bushing 52 may be made of a light-weight material such as plastic.

Reversing mechanism 16 includes a third hose 53C connected to a third hole 60C in bushing 52. A coupling 55 secures hose 53C to a rear end portion of an associated fitting 50 in the same manner as hoses 53A, 53B, except that hose 53C does not communicate with recess 33. Instead, as shown, hole 53C is a blind hole, and a radial port 61 located between front and rear seal bearings 57A, 57B communicates with it. Port 61 is opened and closed by the sliding movement of striker 12 for purposes described hereafter, and may be formed as annular, outwardly opening groove in bushing 52 that communicates with lengthwise hole 60C by means of a single opening 62.

Figure 2:
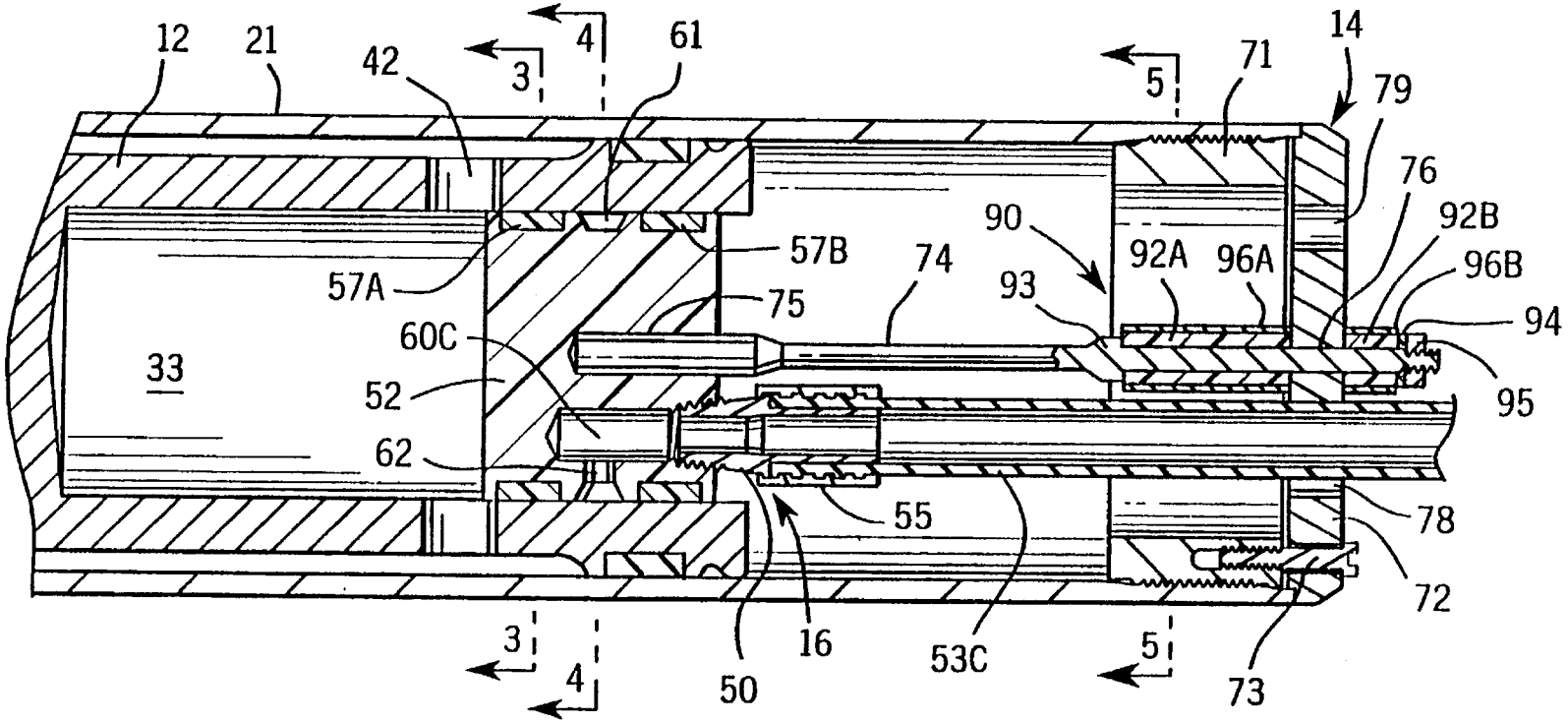
FIG. 2 is enlarged, partial lengthwise sectional view of the rear of the impact tool taken along the line 2—2 in FIG. 6.
Figure 3:
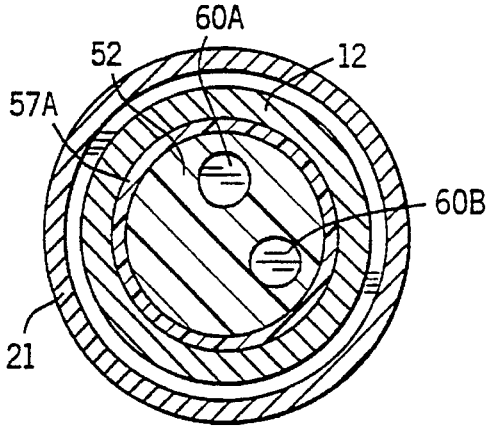
FIG. 3 is a cross-sectional view taken along the line 3—3 in FIG. 2.
Figure 4:
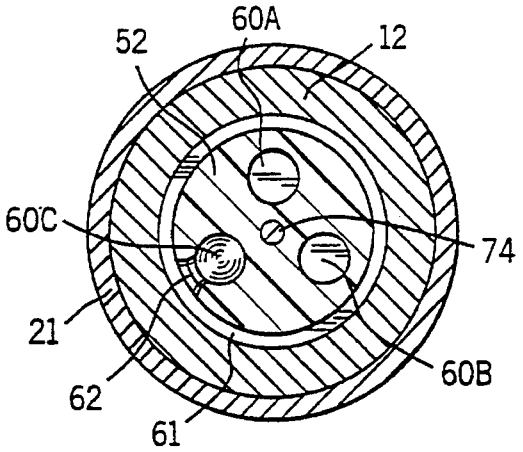
FIG. 4 is a cross-sectional view taken along the line 4—4 in FIG. 2.
Figure 5:
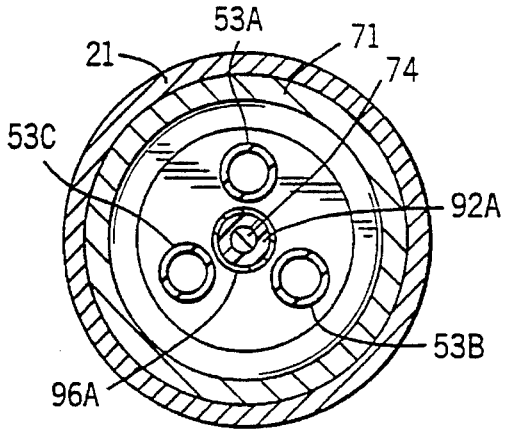
FIG. 5 is a cross-sectional view taken along the line 5—5 in FIG. 1.
Figure 6:
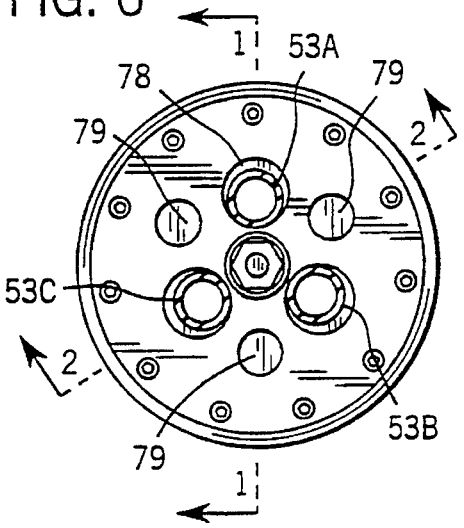
FIG. 6 is a rear end view of the tool of FIGS. 1 and 2.

As shown in FIGS. 2–4, hoses 53A–53C are offset from the central axis of the tool and extend in parallel with the tool axis. Although three hoses are shown in the preferred embodiment, hoses 53A, 53B are separated mainly for reasons of design and do not differ in function. A single hose could be used in place of the pair of hoses shown. However, dividing the main air hose in two as shown permits relocation of the hoses in a symmetrical triangular formation that facilitates manufacture and keeps the weight of the tool more evenly balanced.

Tail assembly 14 according to the invention includes a tail nut 71 threadedly coupled to the interior of tool body 11 near the rear end opening thereof, a disk-shaped end cap 72 and a connecting rod 74 which secures bushing 52 at a predetermined position within the tool body. Unlike similar prior tools, tail nut 71 can be a thin-walled tubular sleeve instead of a generally solid steel cylinder with a small central hole. Nut 71 has a number of small, rearwardly opening threaded holes ranged in a circular formation which align with corresponding holes in end cap 72 so that cap 72 can be secured to nut 71 by means of bolts 73 once nut 71 has been threadedly secured inside of tool body 11.

Rod 74 is preferably made of steel and tapers frontwardly as shown so that it has sufficient ability to stretch under the shock of impact. A front end portion of connecting rod 74 is press-fitted into a hole 75 at the center of bushing 52. A rear threaded end portion of connecting rod 74 extends through a hole 76 at the center of cap 72 and is secured by a washer and nut assembly 77.

Although rod 74 may be directly secured to end cap 72, it is preferred to provide a shock dampening isolator 90 between rod 74 and cap 72 to improve the life of rod 74. Isolator 90 includes a pair of front and rear plastic (Delrin) sleeves 92A, 92B mounted on the outside of rod 74 in contact with opposite sides of cap 72 as shown. Rear sleeve 92A is clamped between a flange 93 formed on rod 74 and the rear face of cap 72. Front sleeve 92B is similarly confined between the front face of cap 72 and a washer 94 held in place by a nut 95. A pair of thin metal sleeves 96A, 96B may be secured around the outsides of plastic sleeves 92A, 92B, respectively, to protect sleeves 92A, 92B. Rear sleeve 92B may be omitted if desired, with shortening of rod 74 so that nut 95, with or without washer 94, would be tightenable against the outside of end cap 72.

It has been found that rigid plastic sleeves 92A, 92B effectively protect rod 74 from the axial shocks that are transmitted through the body each time the striker makes a forward or rearward impact. Conventional shock absorbers used to protect the air inlet from shocks transmitted from the tool body, e.g., as shown in U.S. Pat. Nos. 3,756,328 and 5,025,868 cited above, are made of a rubber or a similar elastomeric material. Surprisingly, it has been found according to the present invention that a stronger, more rigid, non-elastomeric sleeve made of a hard plastic can serve as an effective shock absorber with improved durability.

Figure 7:
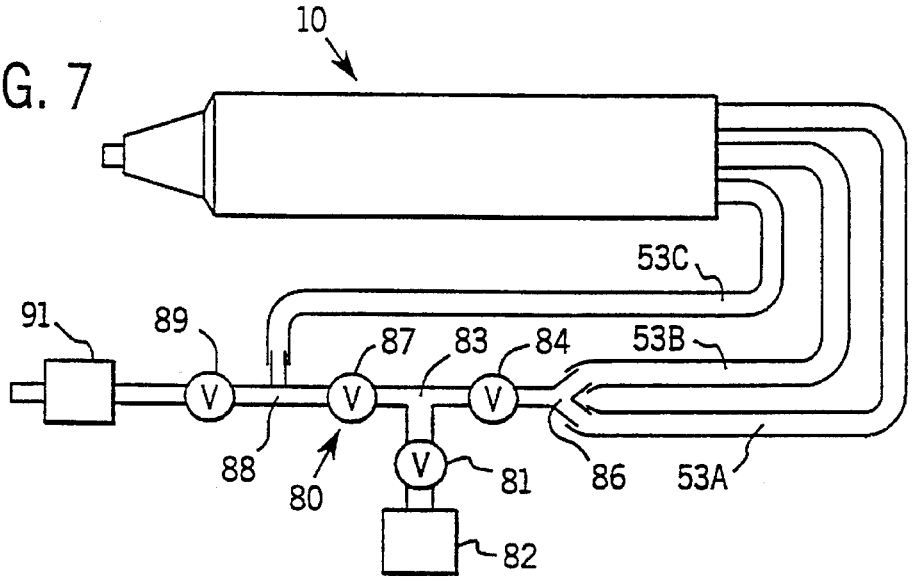
FIG. 7 is a schematic diagram of the tool of FIG. 1 connected to a valve system according to the invention.

Referring to FIG. 7, to operate the hoses 53A–53C, a valve assembly 80 is provided. Valve assembly 80 includes a main shutoff valve 81 which cuts off all air from the air compressor 82. When valve 81 is open, compressed air flows through a branched passage or fitting 83 through a second valve 84 to each of hoses 53A, 53B, which may be connected to valve 84 by branched passage or fitting 86. A further valve 87 regulates air flow through the other branch of passage 83. When valve 87 is open, compressed air enters a further branched passage or fitting 88 to which hose 53C is connected and thereby enters hose 53C. A fourth valve 89 provided on the other branch of passage 88 isolates passage 88 from an exhaust muffler 91.

Figure 8:
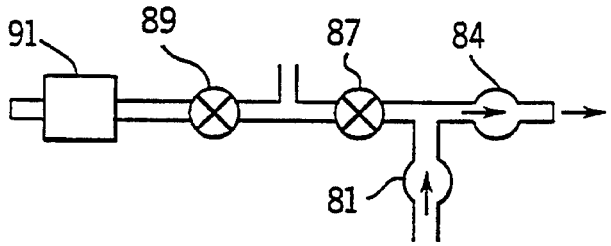
FIG. 8 is a schematic diagram of the valves of FIG. 7 positioned for full-power forward operation.
Figure 9:
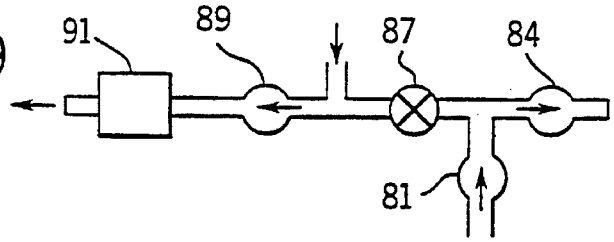
FIG. 9 is a schematic diagram of the valves of FIG. 7 positioned for short-stroke forward operation.
Figure 10:
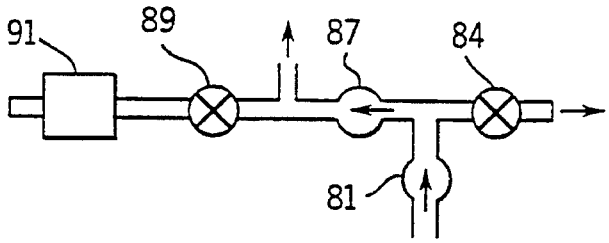
FIG. 10 is a schematic diagram of the valves of FIG. 7 positioned for reverse operation.

Referring now to FIGS. 8 to 10, the tool 10 of the invention can be operated in three different modes depending on the state of each of the air hoses. The latter may be either pressurized, sealed but not pressurized, or open and unpressurized, as described hereafter. In regular forward mode operation, as shown in FIG. 8, valves 81 and 84 are open and valves 87 and 89 are closed. Hoses 53A, 53B are pressurized to drive striker 12 forward so that it impacts against anvil 23 in a manner known in the art to propel the tool forward through the ground. Hose 53C is isolated by valves 87, 89 and remains sealed and unpressurized. By this means, open port 61 has no effect on the tool's operation even though radial ports 42 pass over it during the cycling of the striker 12.

FIG. 9 illustrates the second operating mode, short-stroke forward mode. The configuration is the same as shown in FIG. 8, except that valve 89 is now open. When the striker 12 is moving rearwardly after an impact against anvil 23 in normal forward mode, exhausting of the space 43 does not normally occur until ports 42 pass over the rear edge of bushing 52. Compressed air then flows rearwardly within the tool body and exits through exhaust holes 79 formed in end cap 72 at positions offset from holes 78 through which hoses 53A–53C pass. In short-stroke forward mode, exhausting occurs prematurely because hose 53C is open to the atmosphere, and the rearward momentum of the striker is thereby lessened, shortening the overall stroke.

The reduction in stroke length makes the forward impact less powerful. This is very useful during start-up and other situations where low-power operation is required, such as engaging the head of the tool with a pipe pushing collet. With a full power stroke, the collet or other adapter might become jammed on the tool head, or be damaged. Switching between modes is carried out in a simple manner by opening and closing valve 89 with any need to change the setting of the air compressor. In addition, where valve 89 is of the type that provides continuous adjustment between open, closed, and partially open positions, the operator can use valve 89 to selectively control the forward speed of the tool anywhere between maximum speed (valve closed) and short-stroke forward speed (valve open).

FIG. 10 illustrates the valve configuration for reverse mode operation. Valves 84 and 89 are closed, and valves 81 and 87 are open. Hose 53C is thus pressurized, and hoses 53A, 53B remain sealed and unpressurized. In this state, the point at which the front chamber is pressurized for rearward movement is offset to the rear by the distance from port 61 to the front edge of bushing 52, causing striker 12 to begin the reverse stroke sooner. During the reverse stroke, radial ports 42 become covered by bushing 52 and do not permit communication between recess 33 and outer annular space 43. Since hoses 53A, 53B are sealed, air pressure builds up in recess 33 as the volume of recess 33 decreases due to rearward movement of the striker. When ports 42 pass over the rear edge of bushing 52 and exhausting occurs, the pressure ahead of striker 12 drops, and the force of the pressure in recess 33 then urges the striker forwardly again. The temporary compression of air within recess 33 and hoses 53A, 53B provides an air spring which provides a weak forward stroke to the striker. If needed, a mechanical coil spring could also be provided in recess 33 for a similar purpose with its ends confined by the front end of recess 33 and the front end of bushing 52. If the tool is shut off in the position shown in FIG. 1 so that port 61 is covered by the rear end of striker 12, it will be necessary to start the tool in one of the forward modes before switching to reverse.

The tool of the present invention, when used in combination with the described valve assembly, provides a number of advantages over prior reversing mechanisms. Switching between forward and reverse modes is easily accomplished by opening and closing valves at the compressor with any need to stop the tool and perform manual switching operations, as in a conventional screw reverse. Greater reliability and simplicity are achieved by avoiding the placement of moving valve members and other moving parts in the tool body where such parts would be subject to impacts and shocks during operation. The striker remains the only moving part in the tool itself, and the position of bushing 52 does not change. Further, as noted above, the reversing mechanism of the invention can also provide for a third, short stroke forward mode of operation.

It will be understood that the foregoing description is of preferred exemplary embodiments of the invention, and that the invention is not limited to the specific forms shown. Modifications may be made in without departing from the scope of the invention as expressed in the appended claims.

We claim:

1. A reversible pneumatic ground piercing tool, comprising:

an elongated tool body having a rear opening and a front nose including an anvil;

a striker disposed for reciprocation within an internal chamber of the housing to impart impacts to a rear impact surface of the anvil for driving the tool forwardly through the ground, the striker having a rear bearing in sealed, sliding engagement with an inner wall of the tool body;

an air distributing mechanism for effecting reciprocation of the striker, including a rearwardly-opening recess in the striker having a radial air flow port extending through a wall of the recess, a bushing slidably disposed in the recess in sealed engagement with the recess wall, the bushing having a front external edge, a rear external edge, a first air flow passage extending through the bushing from rear to front in a lengthwise direction, a first air hose connected to the first air flow passage for supplying compressed air to the recess to push the striker forwardly until the radial port in the recess wall passes the front edge of the bushing, at which time compressed air enters a forward pressure chamber ahead of the rear seal bearing of the striker thereby beginning a rearward stroke of the striker, travel of the striker continuing rearwardly until the radial port in the recess wall passes over the rear edge of the bushing, thereby depressurizing the forward pressure chamber;

a tail assembly mounted in a rear end opening of the housing that secures the striker and air distributing mechanism in the housing, and which receives rearward impacts from the striker when the tool is operating in reverse; and a reversing mechanism including a second air flow passage extending from the rear of the bushing to a radial port on an exterior surface of the bushing between the front and rear external edges thereof, and a second air hose connected to the first air flow passage for supplying compressed air to the radial port in the bushing to pressurize the forward pressure chamber when the radial port in the recess wall moves over the radial port in the bushing, thereby beginning a rearward striker stroke sooner than if no compressed air is supplied to the radial port of the bushing.

2. The tool of claim 1, further comprising a first valve connected to the first hose at a location remote from the tool body for sealing and unsealing the first hose for communication with an air compressor, and a second valve at a location remote from the tool body connected to the second hose for sealing and unsealing the second hose for communication with an air compressor.

3. The tool of claim 2, further comprising a branched passage to which the first and second valves are connected, whereby each of the first and second valves can be commonly connected to an air compressor.

4. The tool of claim 2, further comprising a third valve connected to the second hose for sealing and unsealing the second hose to the atmosphere.

5. The tool of claim 4, further comprising a muffler connected to receive exhaust from the second air hose when the second valve is closed and the third valve is open, and to discharge the exhaust to the atmosphere.

6. The tool of claim 4, wherein the tail assembly comprises:

a tail nut having external threads secured in internal threads formed on the inner surface of the tool body near the rear opening;

an end cap covering the rear opening of the tool body, the end cap having openings therein through which the first and second hoses pass;

means for securing the end cap to the tail nut; and a rod connecting the bushing to the end cap.

7. The tool of claim 6, wherein the rod is coaxial with a lengthwise axis of the tool body, and the first and second hoses extend in parallel to the rod at positions radially outwardly from the rod.

8. The tool of claim 7, further comprising means for removably securing front and rear ends of the rod to the bushing and end cap, respectively.

9. The tool of claim 7, wherein the air distributing mechanism for effecting reciprocation of the striker further includes a third air flow passage extending through the bushing from rear to front in a lengthwise direction, and a third air hose connected to the third air flow passage for supplying compressed air to the recess, supplementing compressed air supplied by the first hose, wherein the first, second and third air flow passages and first, second and third hoses are arranged in a triangular formation relative to the rod.

10. The tool of claim 6, wherein the end cap has exhaust holes therein, and the tail nut comprises a thin-walled sleeve that is spaced from the outer periphery of the first and second air hoses, the air hoses being free of attachment to the tail assembly.

11. A method of operating a reversible impact boring tool of the type claimed in claim 4, the first, second and third air valves being located near the air compressor at the end of the hoses remote from the tool, the method comprising:

operating the tool in forward mode by opening the first valve and supplying compressed air to the first hose while closing the second and third valves so that the second hose is substantially sealed;

operating the tool in reverse mode by opening the second valve and closing the third valve to supply compressed air to the second hose, while closing the first valve so that the first hose is substantially sealed; and operating the tool in shortened stroke forward mode by opening the third valve and closing the second valve to permit exhaust from the forward chamber to pass to the atmosphere through the second hose, while opening the first valve and supplying compressed air to the first hose.

12. A method of operating a reversible impact boring tool of the type claimed in claim 2, the method comprising:

operating the tool in forward mode by opening the first valve and supplying compressed air to the first hose while closing the second valve so that the second hose is substantially sealed; and operating the tool in reverse mode by opening the second valve and supplying compressed air to the second hose while closing the first valve so that the first hose is substantially sealed.

* * * * *